US010750874B2

(12) United States Patent
Tsai

(10) Patent No.: US 10,750,874 B2
(45) Date of Patent: Aug. 25, 2020

(54) MODULAR BED ASSEMBLY

(71) Applicant: ULIFE HEALTHCARE INC., Taoyuan (TW)

(72) Inventor: Chi-Lung Tsai, Taichung (TW)

(73) Assignee: ULIFE HEALTHCARE INC., Taoyuan (TW)

( * ) Notice: Subject to any disclaimer, the term of this patent is extended or adjusted under 35 U.S.C. 154(b) by 301 days.

(21) Appl. No.: 15/985,489

(22) Filed: May 21, 2018

(65) Prior Publication Data

US 2019/0191887 A1 Jun. 27, 2019

(30) Foreign Application Priority Data

Dec. 22, 2017 (TW) ..... 106219019 U
Jan. 23, 2018 (TW) ..... 107201111 U

(51) Int. Cl.

| | |
|---|---|
| ***A47C 17/86*** | (2006.01) |
| ***A47C 17/70*** | (2006.01) |
| ***A47C 19/22*** | (2006.01) |
| ***A47C 20/04*** | (2006.01) |
| ***A47C 19/00*** | (2006.01) |

(52) U.S. Cl.

CPC ..... *A47C 17/86* (2013.01); *A47C 17/70* (2013.01); *A47C 19/005* (2013.01); *A47C 19/22* (2013.01); *A47C 20/041* (2013.01); *A47B 2220/04* (2013.01)

(58) Field of Classification Search

CPC ..... A47C 17/70; A47C 17/86; A47C 19/005; A47C 19/22; A47C 20/041; A47B 2220/04

See application file for complete search history.

(56) References Cited

U.S. PATENT DOCUMENTS

| | | | | |
|---|---|---|---|---|
| 3,745,596 A * | 7/1973 | Copeland | A47C 17/86 5/308 |
| 4,811,438 A * | 3/1989 | Simpson | A47C 17/86 297/188.11 |
| 5,520,436 A * | 5/1996 | Rader | A47C 7/62 297/188.11 |
| 2005/0029911 A1* | 2/2005 | Sheng-Bin | A47B 43/04 312/258 |
| 2008/0218041 A1* | 9/2008 | Chiang | A47B 43/00 312/258 |
| 2015/0121623 A1* | 5/2015 | Huang | A61G 7/018 5/616 |

(Continued)

FOREIGN PATENT DOCUMENTS

| | | | |
|---|---|---|---|
| GB | 453278 A * | 9/1936 | A47C 17/70 |
| WO | WO-02076267 A1 * | 10/2002 | B60P 3/39 |

*Primary Examiner* — David R Hare
*Assistant Examiner* — Alexis Felix Lopez
(74) *Attorney, Agent, or Firm* — TraskBritt

(57) ABSTRACT

A modular bed assembly includes a front base frame, a rear base frame, a plurality of legs, and a drawer unit which includes a pair of guiding rails, a lateral faceplate, a flexible receptacle and a pair of guided members. The lateral faceplate defines a plane. The flexible receptacle has an upper marginal edge with two lateral edge segments each defining a lengthwise line, and is transformable between a collapsed state, where the lengthwise line is substantially parallel to the plane, and a deployed state, where the lengthwise line is substantially normal to the plane.

11 Claims, 15 Drawing Sheets

(56) References Cited

U.S. PATENT DOCUMENTS

| | | | | |
|---|---|---|---|---|
| 2018/0064259 | A1* | 3/2018 | Shih | A47C 20/08 |
| 2018/0110665 | A1* | 4/2018 | Totemeier | A61G 7/1086 |
| 2018/0125252 | A1* | 5/2018 | Chung | A47C 20/04 |

* cited by examiner

MODULAR BED ASSEMBLY

CROSS-REFERENCE TO RELATED APPLICATIONS

This application claims priorities from Taiwanese utility model patent application no. 106219019, filed on Dec. 22, 2017, and Taiwanese utility model patent application no. 107201111, filed on Jan. 23, 2018.

TECHNICAL FIELD

The disclosure relates to a modular bed assembly, more particularly to a modular bed assembly with a drawer unit.

BACKGROUND

A conventional modular bed includes a front base frame, a rear base frame, and a plurality of legs. Because the front base frame may be folded on or be disassembled from the rear base frame, and because the legs may be detachable from the front and rear base frames, the modular bed may be received in a box for transportation. A drawer, due to its rigidity and non-foldability, cannot be packed in compact form for the transportation box, and thus is not fit for transportation with such conventional modular bed.

BRIEF SUMMARY

Therefore, an object of the disclosure is to provide a modular bed assembly with a drawer unit.

According to the disclosure, a modular bed assembly includes a front base frame, a rear base frame, a plurality of legs, and a drawer unit. The rear base frame is coupled to and aligned with the front base frame in a longitudinal direction to permit the front and rear base frames to be arranged in a head-to-tail arrangement. The legs are configured to elevate and place the front and rear base frames in a stationary state. The drawer unit includes a pair of guiding rails, a lateral faceplate, a flexible receptacle, and a pair of guided members. The guiding rails are mounted beneath one of the front and rear base frames, and are spaced apart front each other in the longitudinal direction. The lateral faceplate defines a plane. The flexible receptacle includes a bottom wall and a peripheral wall. The peripheral wall extends upwardly from a periphery of the bottom wall to terminate at an upper marginal edge, which has two lateral edge segments each defining a lengthwise line. The peripheral wall is attached to the lateral faceplate along a longitudinal line such that the flexible receptacle is transformable between a collapsed state, where the lengthwise line is substantially parallel to the plane, and a deployed state, where the lengthwise line is substantially normal to the plane. Each of the guided members extends lengthwise to permit a respective one of the lateral edge segments to be attached thereto along the lengthwise line, and is configured to be slidably retained and guided by a respective one of the guiding rails so as to permit the flexible receptacle to be kept in the deployed state.

BRIEF DESCRIPTION OF THE DRAWINGS

Other features and advantages of the disclosure will become apparent in the following detailed description of the embodiment(s) with reference to the accompanying drawings, in which.

DETAILED DESCRIPTION

Figure 1:
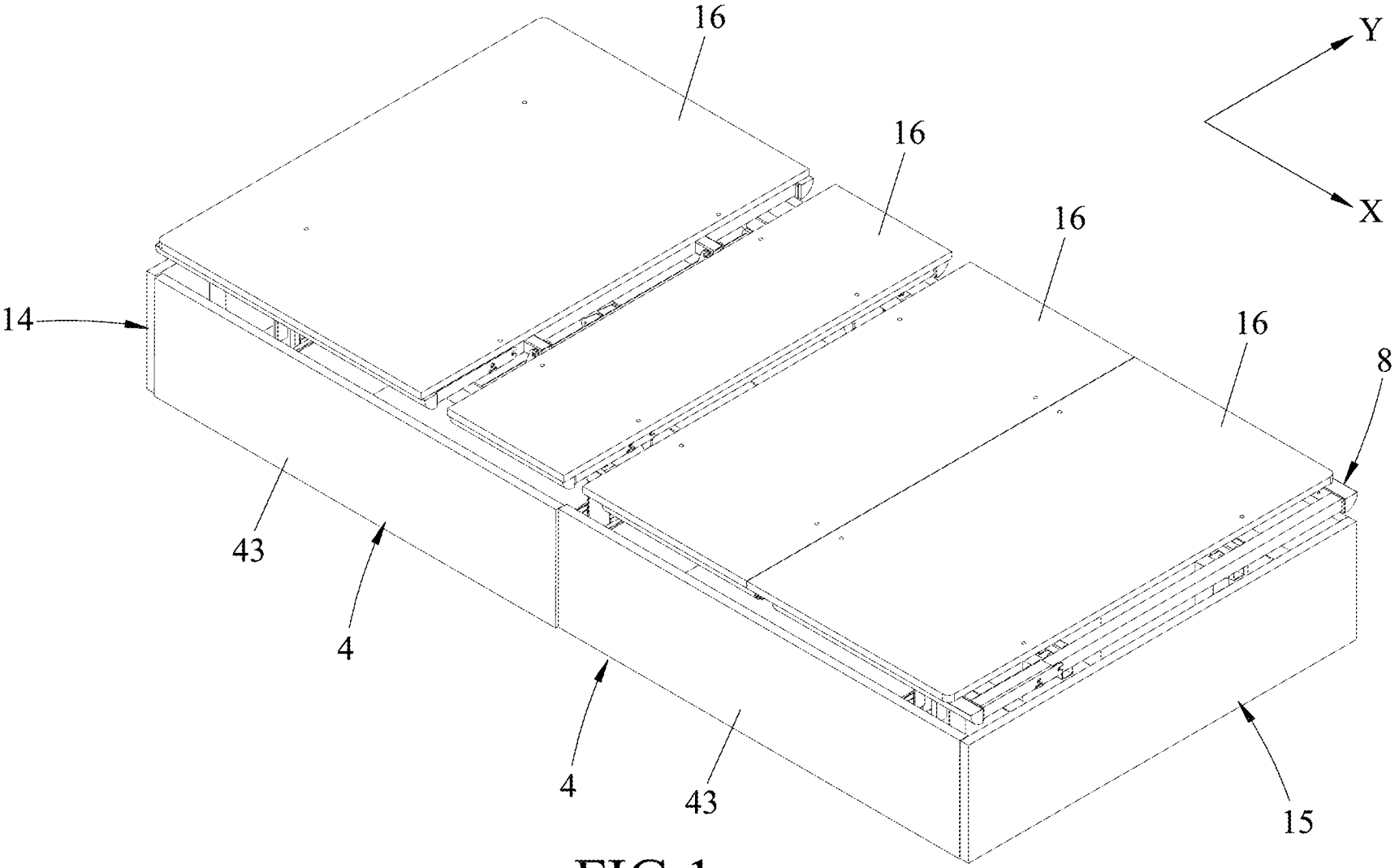
FIG. 1 is a perspective view of a modular bed assembly according to a first embodiment of the disclosure.

Before the disclosure is described in greater detail, it should be noted that where considered appropriate, reference numerals have been repeated among the figures to indicate corresponding or analogous elements, which may optionally have similar characteristics.

To aid in describing the disclosure, directional terms may be used in the specification and claims to describe portions of the present disclosure (e.g., front, rear, left, right, top, bottom, etc.). These directional definitions are intended to merely assist in describing and claiming the disclosure and are not intended to limit the disclosure in any way.

Figure 2:
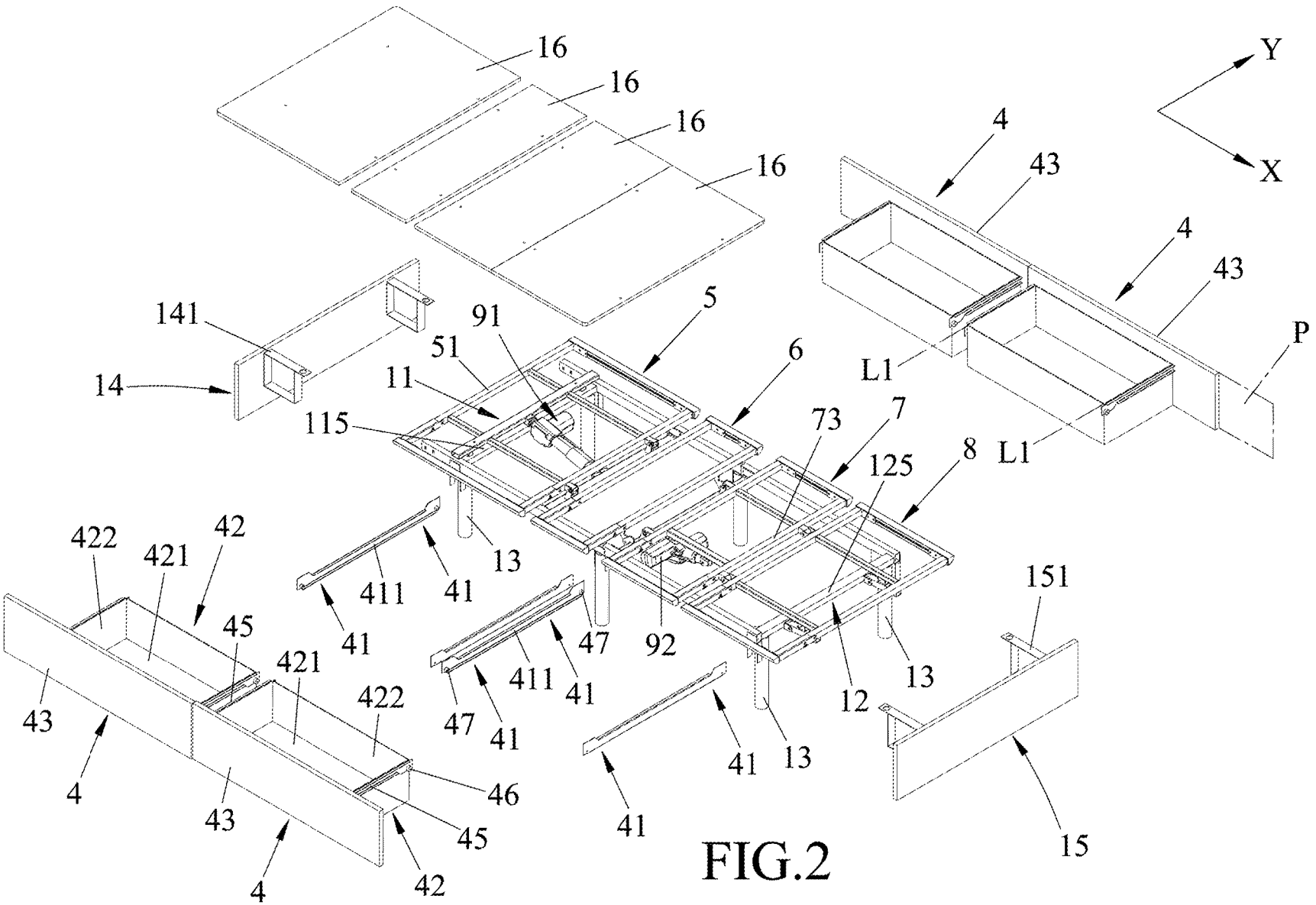
FIG. 2 is an exploded perspective view of the modular bed assembly of the first embodiment.
Figure 3:
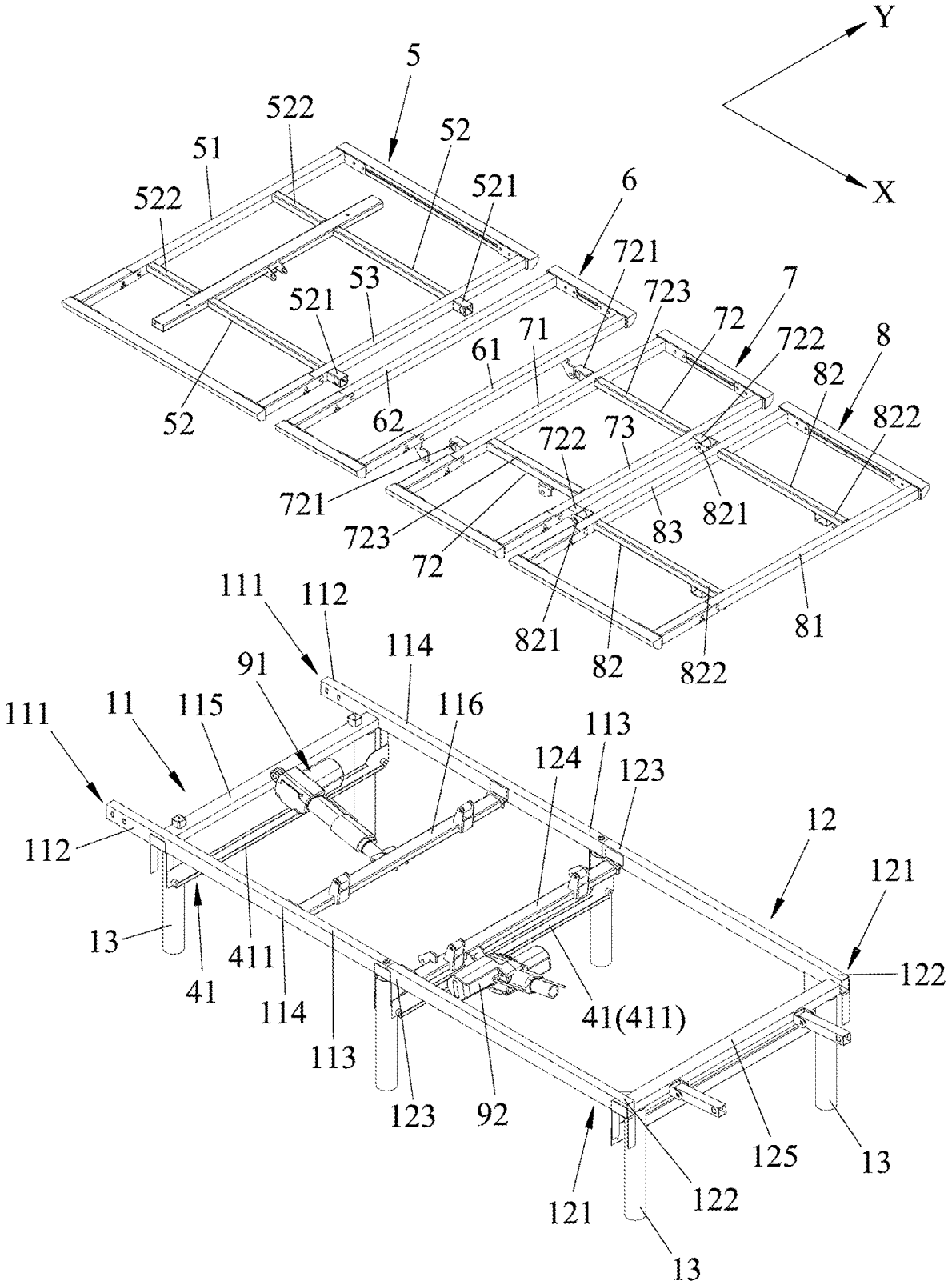
FIG. 3 is an exploded perspective view of the modular bed assembly of the first embodiment in which drawer units, front and rear faceplates, and support panels are omitted.

Referring to FIGS. 1 through 3, a modular bed assembly according to a first embodiment of the disclosure is shown to include a front base frame 11, a rear base frame 12, a plurality of legs 13, and a drawer unit 4.

As shown in FIG. 3, the rear base frame 12 is coupled to and aligned with the front base frame 11 in a longitudinal direction (X) to permit the front and rear base frames 11, 12 to be arranged in a head-to-tail arrangement.

In an embodiment shown in FIG. 3, the front base frame 11 includes two front beams 111, a first front transverse beam 115, and a second front transverse beam 116, and the rear base frame 12 includes two rear beams 121, a first rear transverse beam 124, and a second rear transverse beam 125. Each of the front beams 111, the first and second front transverse beams 115, 116, the rear beams 121, and the first and second rear transverse beams 124, 125 may be a square, hollow metal tube.

Each of the front beams 111 extends in the longitudinal directions (X) to terminate at a front end segment 112 and a first connecting end segment 113, and has an intermediate segment 114 between the front end segment 112 and the first connecting end segment 113. The front beams 111 are spaced apart from each other in a transverse direction (Y) relative to the longitudinal direction (X).

The first front transverse beam 115 extends to interconnect the front end segments 112 of the front beams 111. The second front transverse beam 116 extends to interconnect the intermediate segments 114 of the front beams 111. In an embodiment, two ends of each of the first and second front transverse beams 115, 116 are detachably connected to the front beams 111, respectively.

The rear beams 121 are spaced apart from each other in the transverse direction (Y). Each of the rear beams 121 extends in the longitudinal direction (X) to terminate at a rear end segment 122 and a second connecting end segment 123. The second connecting end segment 123 is connected to the first connecting end segment 113 of a respective one of the front beams 111. In an embodiment, the rear beams 121 are detachably connected to the front beams 111, respectively.

The first rear transverse beam 124 extends to interconnect the second connecting end segments 123 of the rear beams 121. The second rear transverse beam 125 extends to interconnect the rear end segments 122 of the rear beams 121. In an embodiment, two ends of each of the first and second rear transverse beams 124, 125 are detachably connected to the rear beams 121, respectively.

The legs 13 are configured to elevate and place the front and rear base frames 11, 12 in a stationary state. In an embodiment, the legs 13 can be detachably mounted to one of the front and rear base frames 11, 12.

The drawer unit 4 includes a pair of guiding rails 41, a lateral faceplate 43, a flexible receptacle 42, and a pair of guided members 45.

The guiding rails 41 are mounted beneath one of the front and rear base frames 11, 12, and are spaced apart front each other in the longitudinal direction (X). In an embodiment shown in FIGS. 2 and 5, each of the guiding rails 41 defines a guiding groove 411.

The lateral faceplate 43 defines a plane (P). In an embodiment, the lateral faceplate 43 is made of a rigid material such as natural wood, plywood, a plastic material, and so on. In other embodiment, the lateral faceplate 43 may be integrally formed with the flexible receptacle 42.

Furthermore, the lateral faceplate 43 may have a longitudinal dimension substantially not greater than that of a corresponding one of the front and rear base frames 11, 12. In other words, the longitudinal dimension of the lateral faceplate is not greater than the length of each of the front and rear beams 111, 121.

Figure 6:
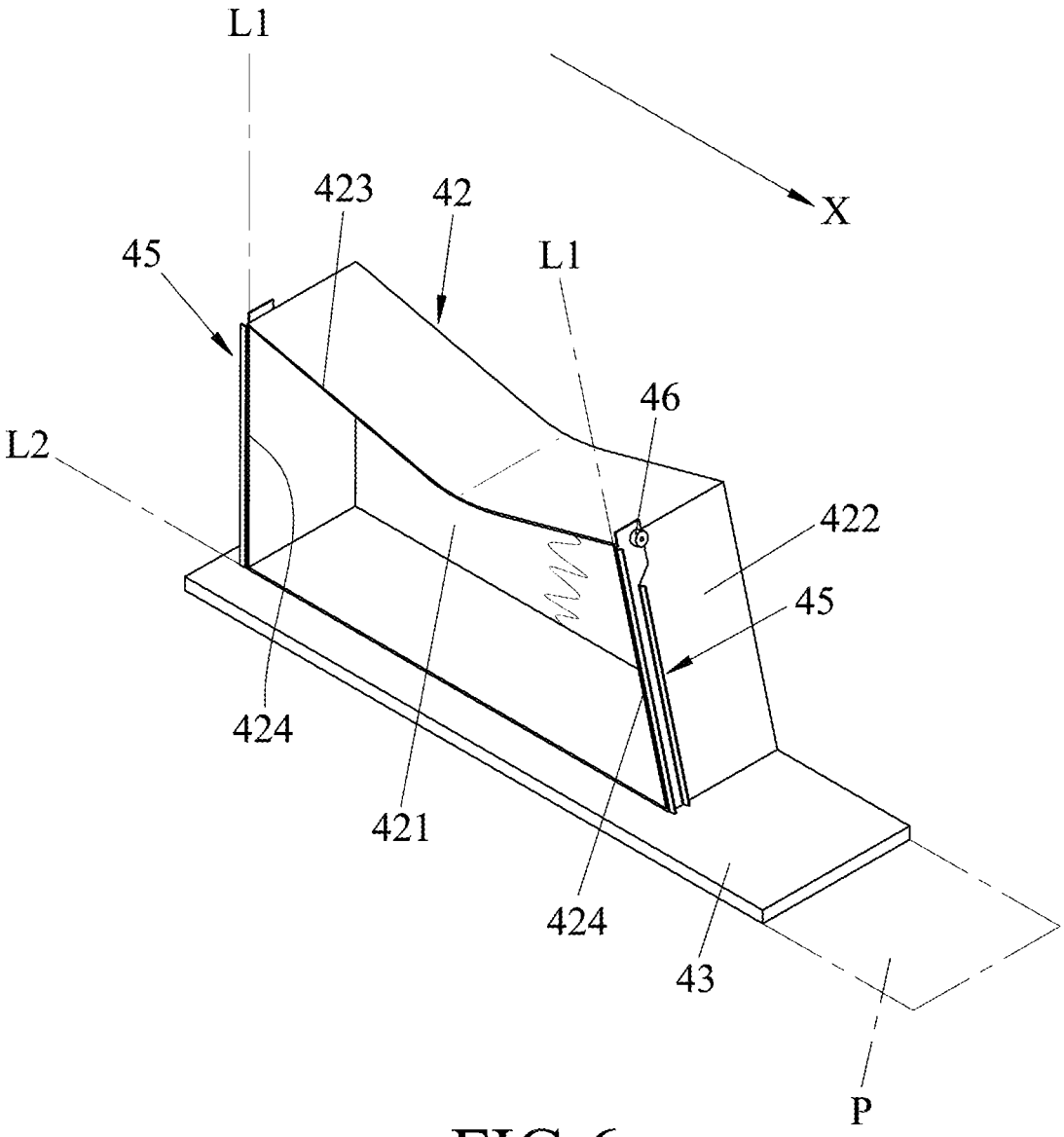
FIG. 6 is a perspective view of one of the drawer units in which guiding rails are omitted.
Figure 7:
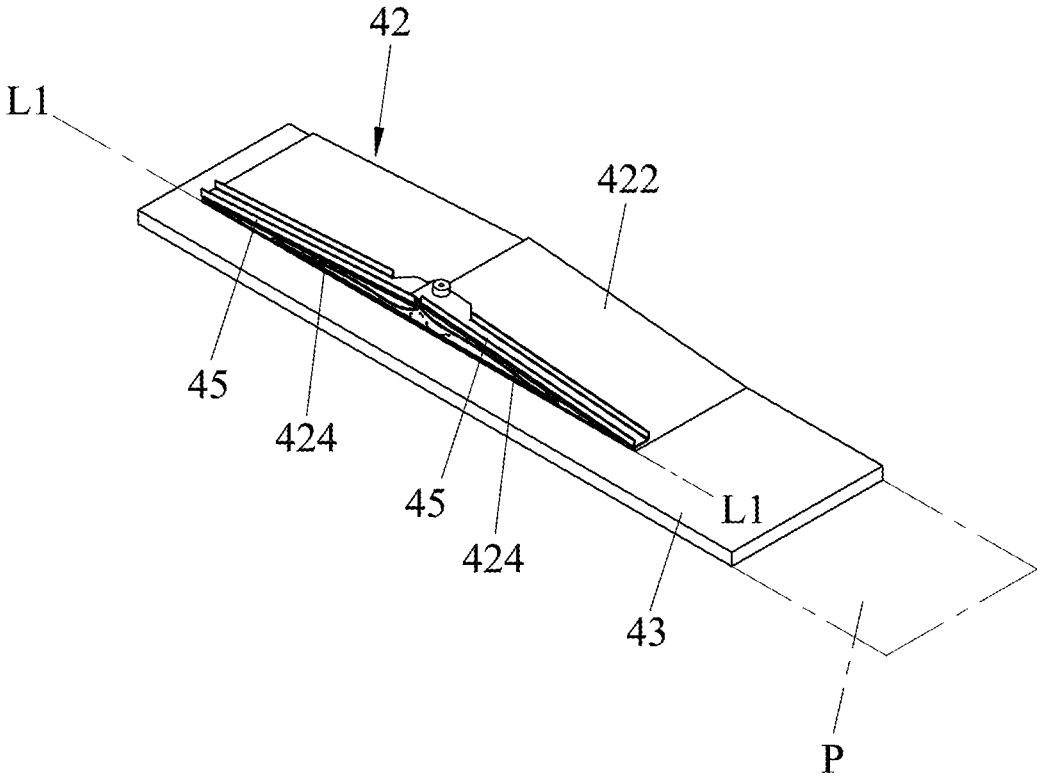
FIG. 7 is similar to FIG. 6 but illustrating a flexible receptacle of the drawer unit in a collapsed state.
Figure 8:
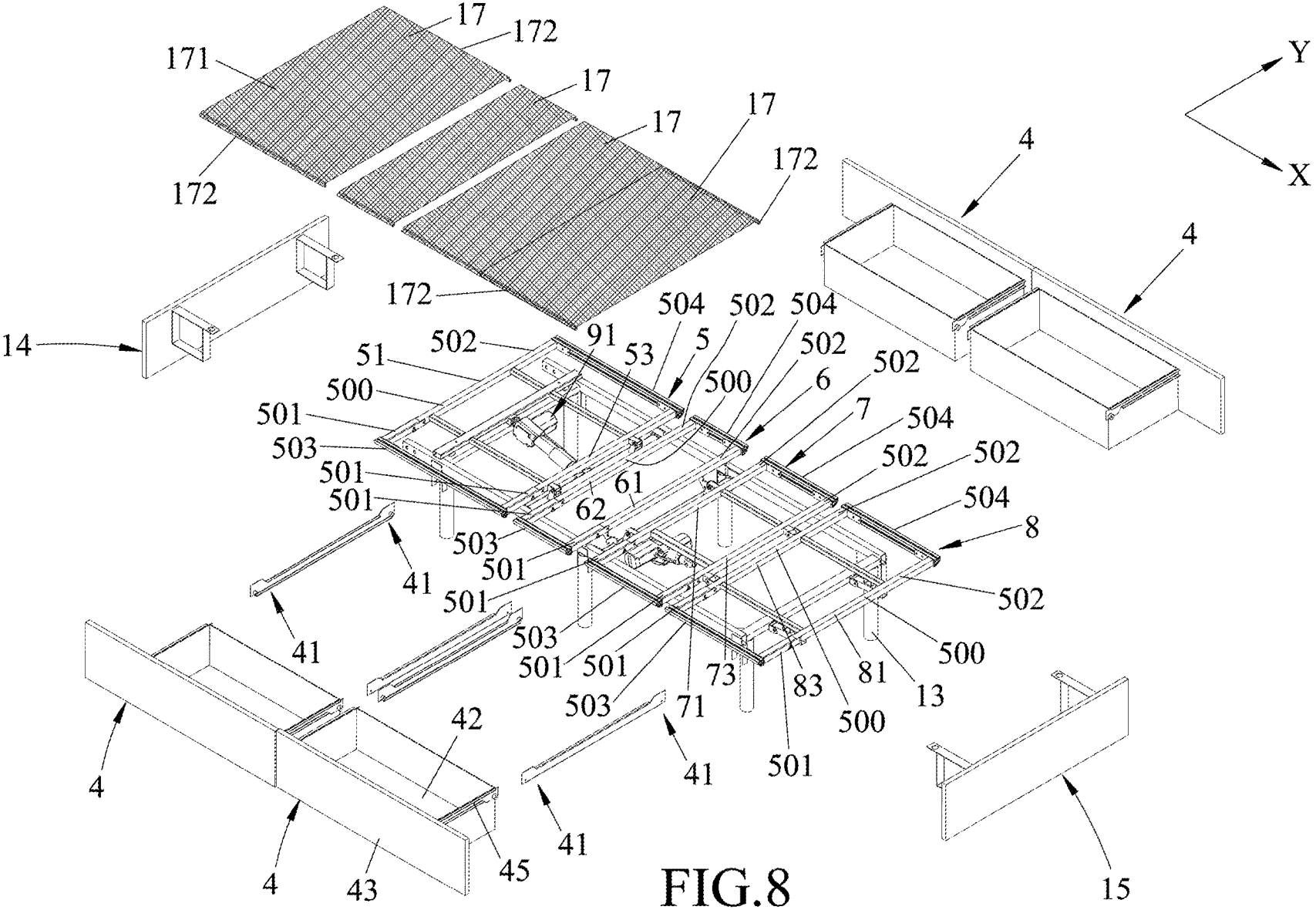
FIG. 8 is an exploded perspective view of a modular bed assembly according to a second embodiment of the disclosure.

As shown in FIGS. 2, 6, and 7, the flexible receptacle 42 includes a bottom wall 421 and a peripheral wall 422. The peripheral wall 422 extends upwardly from a periphery of the bottom wall 421 to terminate at an upper marginal edge 423 which has two lateral edge segments 424 each defining a lengthwise line (L1). The peripheral wall 422 is attached to the lateral faceplate 43 along a longitudinal line (L2) such that the flexible receptacle 42 is transformable between a collapsed state and a deployed state. In the collapsed state, as shown in FIG. 7, the lengthwise line (L1) is substantially parallel to the plane (P). In the deployed state, as shown in FIG. 2, the lengthwise line (L1) is substantially normal to the plane (P). FIG. 6 illustrates a state of the flexible receptacle 42 between the collapsed state and the deployed state.

The flexible receptacle 42 may be made from any flexible, foldable, and/or pliable material, such as woven or nonwoven fabrics, canvas, duck, or the like.

Each of the guided members 45 extends lengthwise to permit a respective one of the lateral edge segments 424 to be attached thereto along the lengthwise line (L1). Each of the guided members 45 is configured to be slidably retained and guided by a respective one of the guiding rails 41 so as to permit the flexible receptacle 42 to be kept in the deployed state.

Because (i) the longitudinal dimension of the lateral faceplate is not greater than the length of each of the front and rear beams 111, 121, (ii) the flexible receptacle 42 can be transformed to the collapsed state, and (iii) the elements of the front and rear base frames 11, 12 may be disassembled, the modular bed assembly with the drawer unit 4 can be compactly received in a box for transportation.

Figure 5:
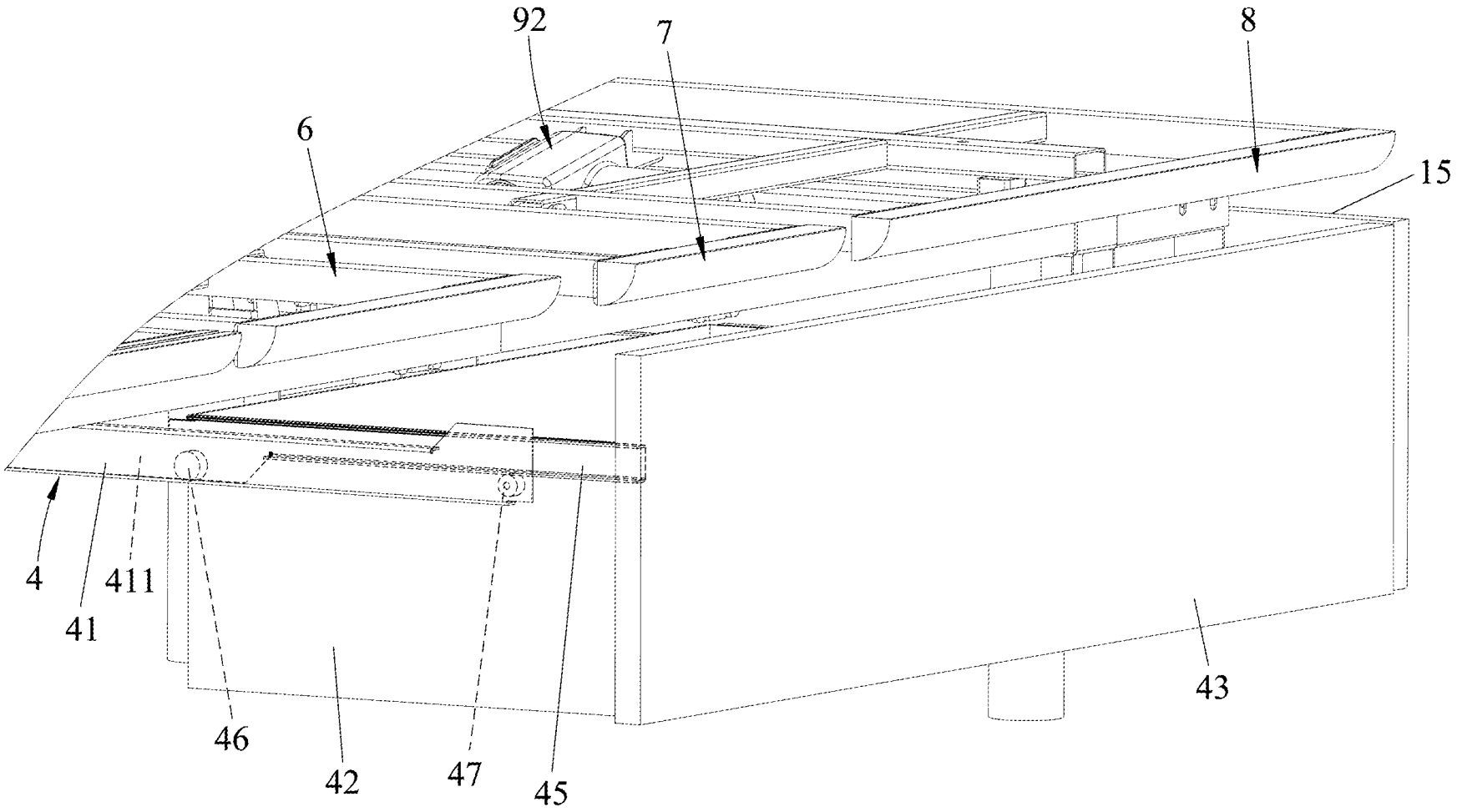
FIG. 5 is a fragmentary enlarged view of the modular bed assembly of the first embodiment.

In an embodiment shown in FIGS. 5-7, the drawer unit 4 further includes a pair of drawer-side rollers 46 and a pair of rail-side rollers 47. The drawer-side rollers 46 are disposed on the guided members 45, respectively. The rail-side rollers 47 are disposed on the guiding rails 41, respectively. With the provision of the drawer-side rollers 46 and the rail-side rollers 47, the flexible receptacle 42 in the deployed state can be more smoothly slid relative to the guiding rails 41.

In an embodiment shown in FIGS. 1 and 2, the modular bed assembly includes a plurality of the drawer units 4. Two corresponding ones of the guiding rails 41 of the drawer units 4, which are in alignment with each other in the transverse direction (Y), may be integrally formed.

In an embodiment shown in FIGS. 1 and 2, the modular bed assembly further includes a front faceplate 14 and a rear faceplate 15.

The front faceplate 14 is detachably mounted to the front base frame 11 so as to hide from view a space between the first front transverse beam 115 and the ground.

Similarly, the rear faceplate 15 is detachably mounted to the rear base frame 12 so as to hide from view a space between the second rear transverse beam 125 and the ground.

In an embodiment shown in FIG. 2, the front faceplate 14 is detachably mounted to the first front transverse beam 115 by virtue of a mounting frame 141, and the rear faceplate 15 is detachably mounted to the second rear transverse beam 125 by virtue of a mounting frame 151.

Moreover, the front faceplate 14 and the rear faceplate 15 may be made of a rigid material such as natural wood, plywood, a plastic material, and so on.

In addition, outer surfaces of the lateral faceplate 43, the front faceplate 14, and the rear faceplate 15 may have the same pattern.

Figure 4:
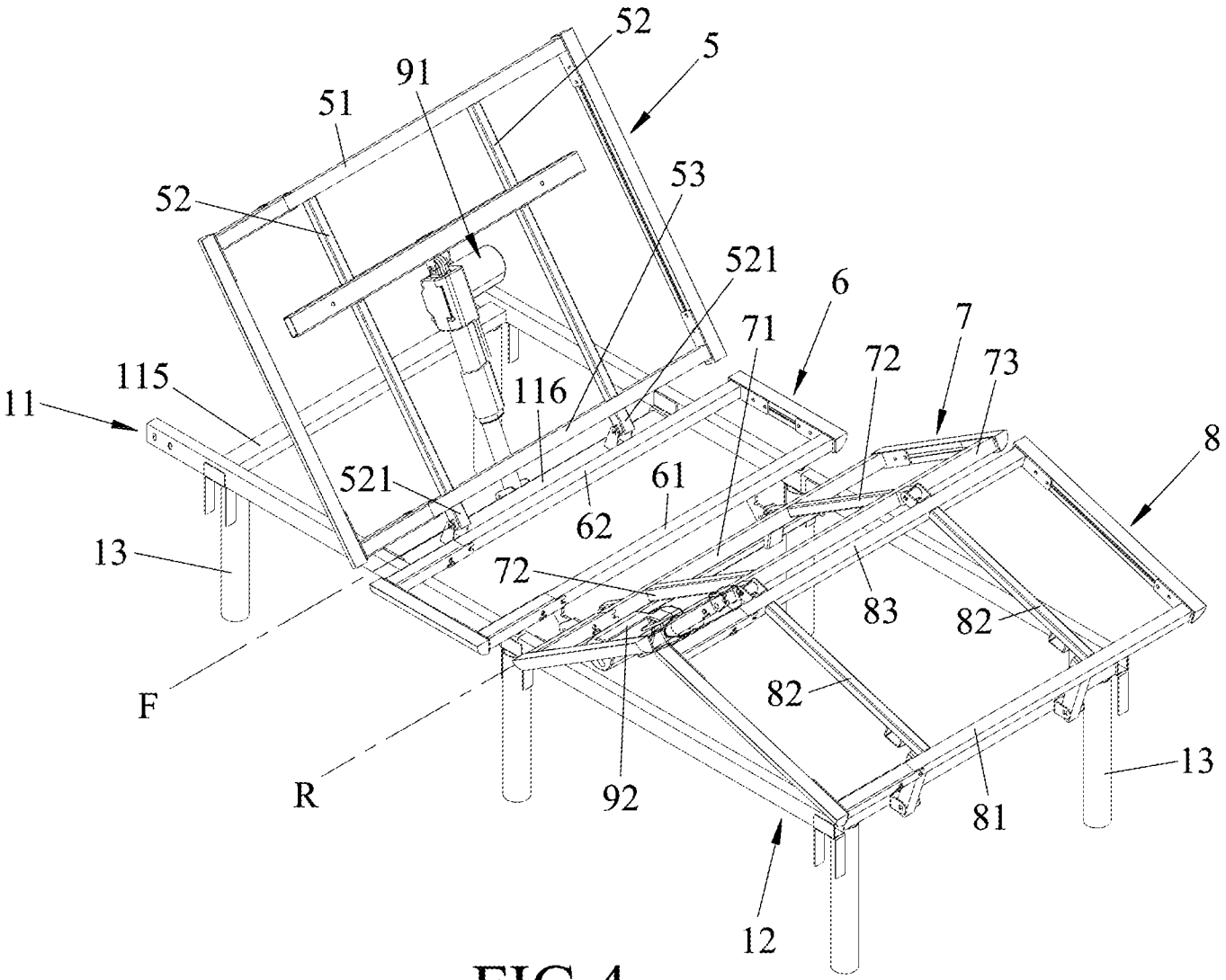
FIG. 4 is a perspective view illustrating the elements shown in FIG. 3 in an assembled state.

In an embodiment shown in FIGS. 2-4, the modular bed assembly further includes a first front support frame unit 5, a second front support frame unit 6, a first rear support frame unit 7, and a second rear support frame unit 8.

The first front support frame unit 5 is mounted on the front base frame 11, and includes a front leading bar 51, a pair of head support links 52, and a first front intermediate bar 53.

The front leading bar 51 extends in the transverse direction (Y).

Each of the head support links 52 has a front link pivot end 521 and a front link coupling end 522. The front link pivot end 521 is mounted pivotally on the second front transverse beam 116 about a front axis (F) in proximity to a respective one of the intermediate segments 114 of the front beams 111. The front link coupling end 522 is opposite to the front link pivot end 521, and is connected to the front leading bar 51 to permit the head support links 52 to move with the front leading bar 51 such that the front leading bar 51 is rotatably liftable about the front axis (F) from a head normal position to a head elevated position. In the head normal position, as shown in FIG. 2, the front leading bar 51 is close to the ground. In the head elevated position, as shown in FIG. 4, the front leading bar 51 is remote from the ground.

The first front intermediate bar 53 extends in the transverse direction (Y) to interconnect the head support links 52 in proximity to the front link pivot ends 521 of the head support links 52 so as to move with the head support links 52.

The second front support frame unit 6 is mounted on the front base frame 11, and is disposed rearwardly of the first front support frame unit 5. The second front support frame unit 6 includes a front trailing bar 61 and a second front intermediate bar 62.

The front trailing bar 61 is spaced apart from the first front intermediate bar 53 in the longitudinal direction (X), and extends in the transverse direction (Y).

The second front intermediate bar 62 extends in the transverse direction (Y), and is disposed between the first front intermediate bar 53 and the front trailing bar 61. The second front intermediate bar 62, together with the front trailing bar 61, is secured on the front beams 111.

The first rear support frame unit 7 is mounted on the rear base frame 12, and includes a rear leading bar 71, a pair of front leg support links 72, and a first rear intermediate bar 73.

The rear leading bar 71 extends in the transverse direction (Y).

Each of the front leg support links 72 has a first forward pivot end segment 721, a first rearward pivot end segment 722, and a first link body 723 disposed between the first forward and rearward pivot end segments 721, 722. The first forward pivot end segment 721 is mounted pivotally on the first rear transverse beam 124 about a rear axis (R) in proximity to a respective one of the second connecting end segments 123 of the rear base frame 12, and is connected to the first link body 723 through the rear leading bar 71 so as to permit the rear leading bar 71 to move with the front leg support links 72.

The first rear intermediate bar 73 extends in the transverse direction (Y) to interconnect the first link body 723 and the first rearward pivot end segment 722 of each of the front leg support links 72 so as to permit the first rear intermediate bar 73 to be rotatably liftable about the rear axis (R) from a leg normal position to a leg elevated position. In the leg normal position, as shown in FIG. 2, the first rear intermediate bar 73 is close to the ground. In the leg elevated position, as shown in FIG. 4, the first rear intermediate bar 73 is remote from the ground.

The second rear support frame unit 8 is mounted on the rear base frame 12, and is disposed rearwardly of the first rear support frame unit 7. The second rear support frame unit 8 includes a rear trailing bar 81, a pair of rear leg support links 82, and a second rear intermediate bar 83.

The rear trailing bar 81 is spaced apart from the first rear intermediate bar 73 in the longitudinal direction (X), and extends in the transverse direction (Y).

Each of the rear leg support links 82 has a second forward pivot end 821 and a second rearward connected end 822. The second forward pivot end 821 is hingedly mounted to the first rearward pivot end segment 722 of a respective one of the front leg support links 72. The second rearward connected end 822, is opposite to the second forward pivot end 821, and is mounted on the rear trailing bar 81.

The second rear intermediate bar 83 extends in the transverse direction (Y) through the rear leg support links 82 in proximity to the second forward pivot ends 821 of the rear leg support links 82 so as to permit the second rear intermediate bar 83 to be lifted when the first rear intermediate bar 73 is lifted to the leg elevated position from the leg normal position.

In an embodiment shown in FIGS. 2-4, the modular bed assembly further includes a front jack member 91 and a rear jack member 92, which can be operated independently.

The front jack member 91 is coupled between the front base frame 11 and the first front support frame unit 5 so as to permit the front leading bar 51 to be driven by the front jack member 91 to move between the head normal position and the head elevated position.

The rear jack member 92 is coupled between the rear base frame 12 and the first rear support frame unit 7 so as to permit the first rear intermediate bar 73 to be driven by the rear jack member 92 to move between the leg normal position and the leg elevated position.

In an embodiment shown in FIGS. 1 and 2, the modular bed assembly further includes four support panels 16 which are detachably mounted to the first and second front support frame units 5, 6 and first and second rear support frame units 7, 8, respectively. The support panels 16 may be made from a rigid material, such as natural wood, plywood, a plastic material, and so on.

FIGS. 8-11 illustrate a modular bed assembly according to a second embodiment of the disclosure. The second embodiment is similar to the first embodiment, except that in the second embodiment, four support webs 17 are used in place of the support panels 16.

In the second embodiment, each of the front leading bar 51, the first front intermediate bar 53, the second front intermediate bar 62, the front trailing bar 61, the rear leading bar 71, the first rear intermediate bar 73, the second rear intermediate bar 83, and the rear trailing bar 81 has a first end segment 501 and a second end segment 502 opposite to the first end segment 501 in the transverse direction (Y). Each of the first and second front support frame units 5, 6 and first and second rear support frame units 7, 8 further includes a first retaining member 503 and a second retaining member 504.

The first retaining member 503 interconnects the first end segments 501 of two corresponding ones of the front leading bar 51, the first front intermediate bar 53, the second front intermediate bar 62, the front trailing bar 61, the rear leading bar 71, the first rear intermediate bar 73, the second rear intermediate bar 83, and the rear trailing bar 81.

The second retaining member 504 interconnects the second end segments 502 of two corresponding ones of the front leading bar 51, the first front intermediate bar 53, the second front intermediate bar 62, the front trailing bar 61, the rear leading bar 71, the first rear intermediate bar 73, the second rear intermediate bar 83, and the rear trailing bar 81.

Each of the support webs 17 is configured to be stretchable on a respective one of the first and second front support frame units 5, 6 and the first and second rear support frame units 7, 8. Each of the support webs 17 includes a web body 171 and two lateral portions of respective tubular sleeves 172.

The lateral portions of respective tubular sleeves 172 are at opposite sides of the web body 171, and are respectively coupled to the first and second retaining members 503, 504 of the respective one of the first and second front support frame units 5, 6 and the first and second rear support frame units 7, 8 so as to permit the web body 171 to be fully stretched between the respective first and second retaining members 503, 504.

In an embodiment shown in FIGS. 8-11, each of the front leading bar 51, the first front intermediate bar 53, the second front intermediate bar 62, the front trailing bar 61, the rear leading bar 71, the first rear intermediate bar 73, the second rear intermediate bar 83, and the rear trailing bar 81 further has a middle segment 500 which is disposed between the first and second end segments 501, 502, and which the first end segment 501 is pivotally mounted to. As such, the first retaining member 503 is angularly movable about a pivot axis between a non-stretching position (FIG. 10) and a stretching position (FIG. 11), where the web body 171 is fully stretched between the respective first and second retaining members 503, 504.

Figure 9:
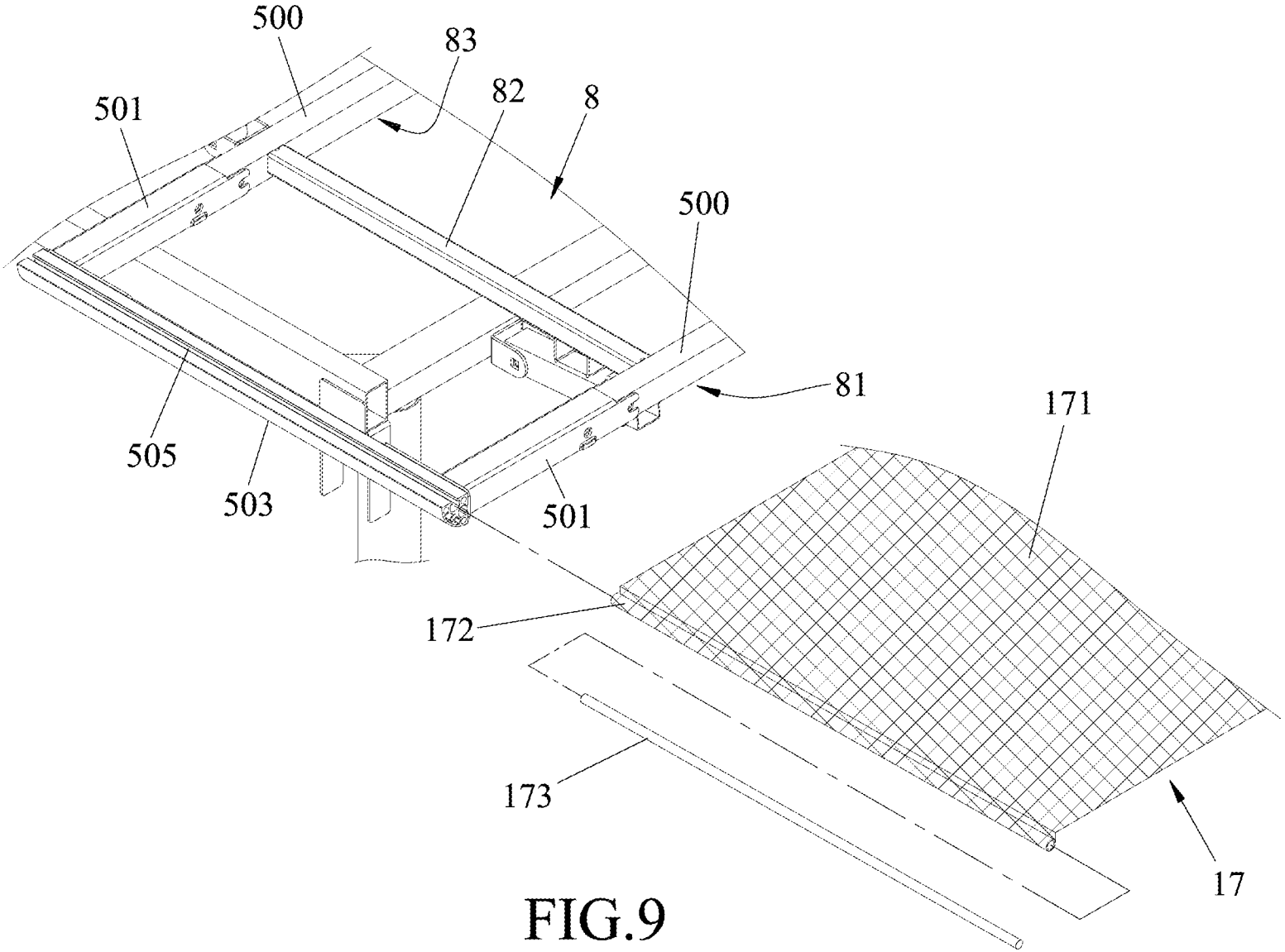
FIG. 9 is a fragmentary exploded enlarged view illustrating how a lateral portion of a web body in the modular bed assembly of the second embodiment is led into an elongated retaining groove of a retaining member.
Figure 10:
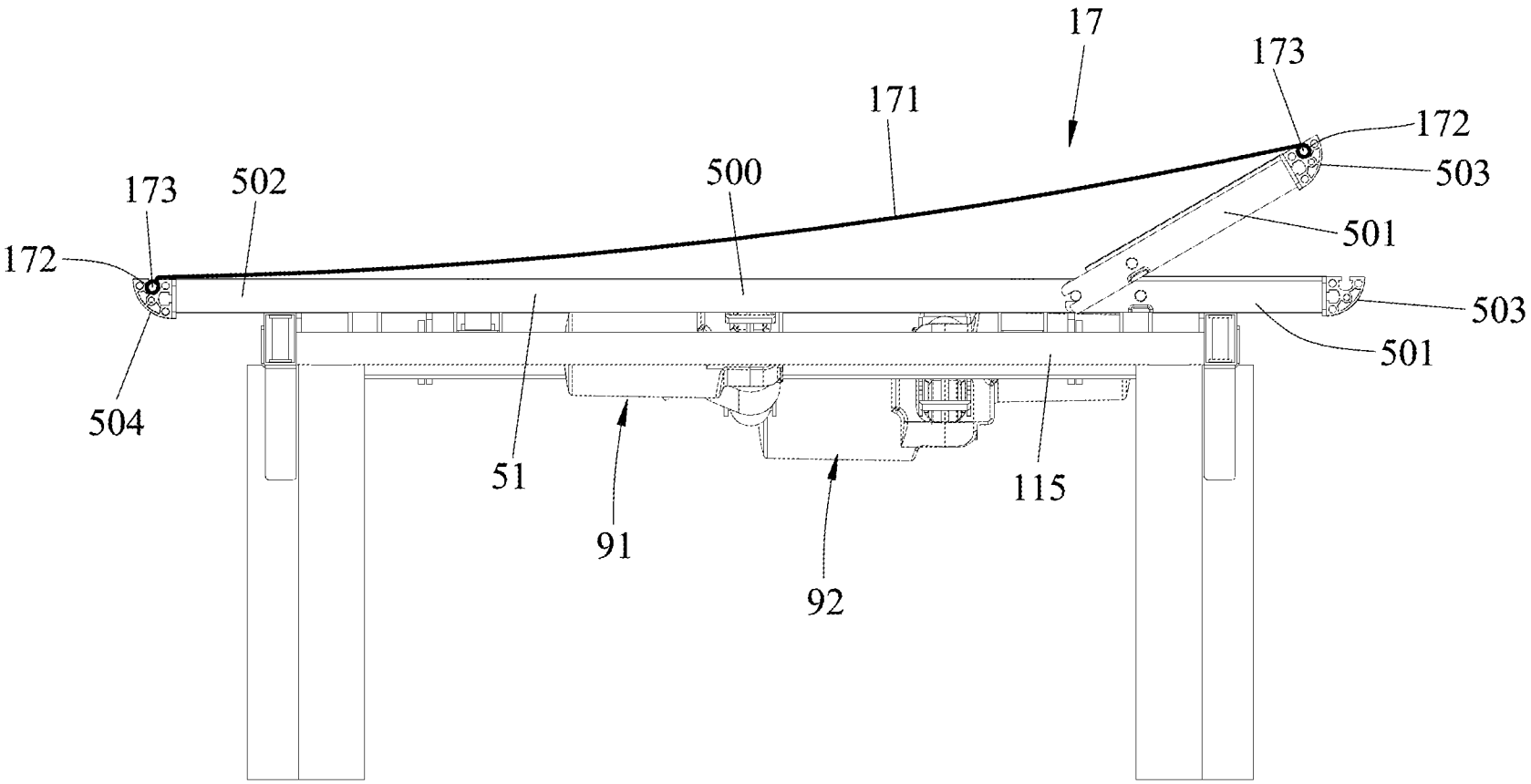
FIG. 10 is a front side view of the modular bed assembly of the second embodiment in which drawer units are omitted.
Figure 11:
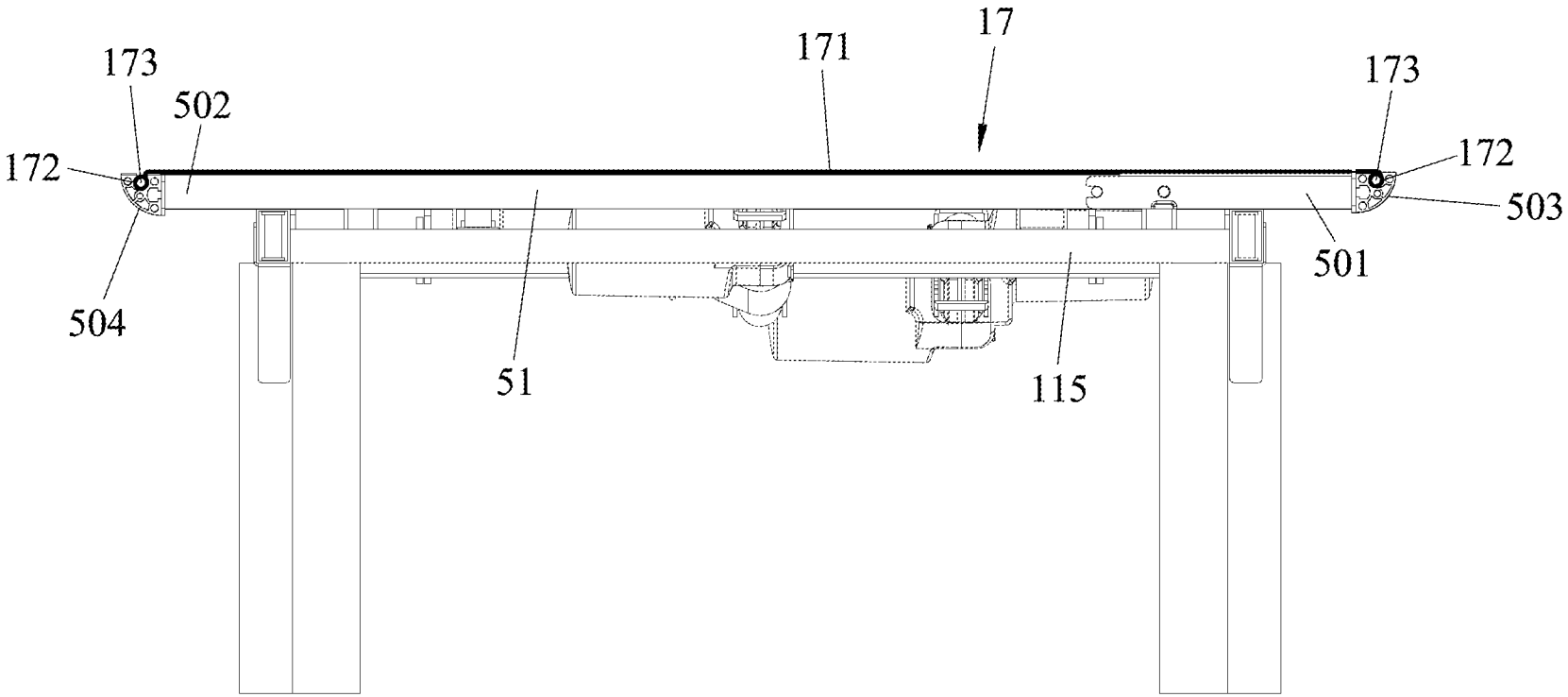
FIG. 11 is similar to FIG. 10 but illustrating first retaining members in a stretching position.

In addition, each of the first and second retaining members 503, 504 has an elongated retaining groove 505 (see FIG. 9). Each of the lateral portions of respective tubular sleeves 172 is enlarged compared to the web body 171, and is in the form of a tubular sleeve. The modular bed assembly further includes eight reinforced rods 173 (only one is shown in FIG. 9). Each of the reinforced rods 173 is configured to be inserted into the respective tubular sleeve 172 to ensure the respective tubular sleeve 172 be retained in the respective elongated retaining groove 505 when the first retaining member 503 is displaced to the stretching position (FIG. 11) from the non-stretching positions (FIG. 10).

FIGS. 12-15 illustrate a modular bed assembly according to a third embodiment of the disclosure. The third embodiment is similar to the first embodiment, except that the drawer unit 4 further includes a pair of crosspieces 44 each interconnecting the guided members 45. The crosspieces 44 and the guided members 45 are integrally formed so as to stiffen the upper marginal edge 423 of the flexible receptacle 42.

Figure 12:
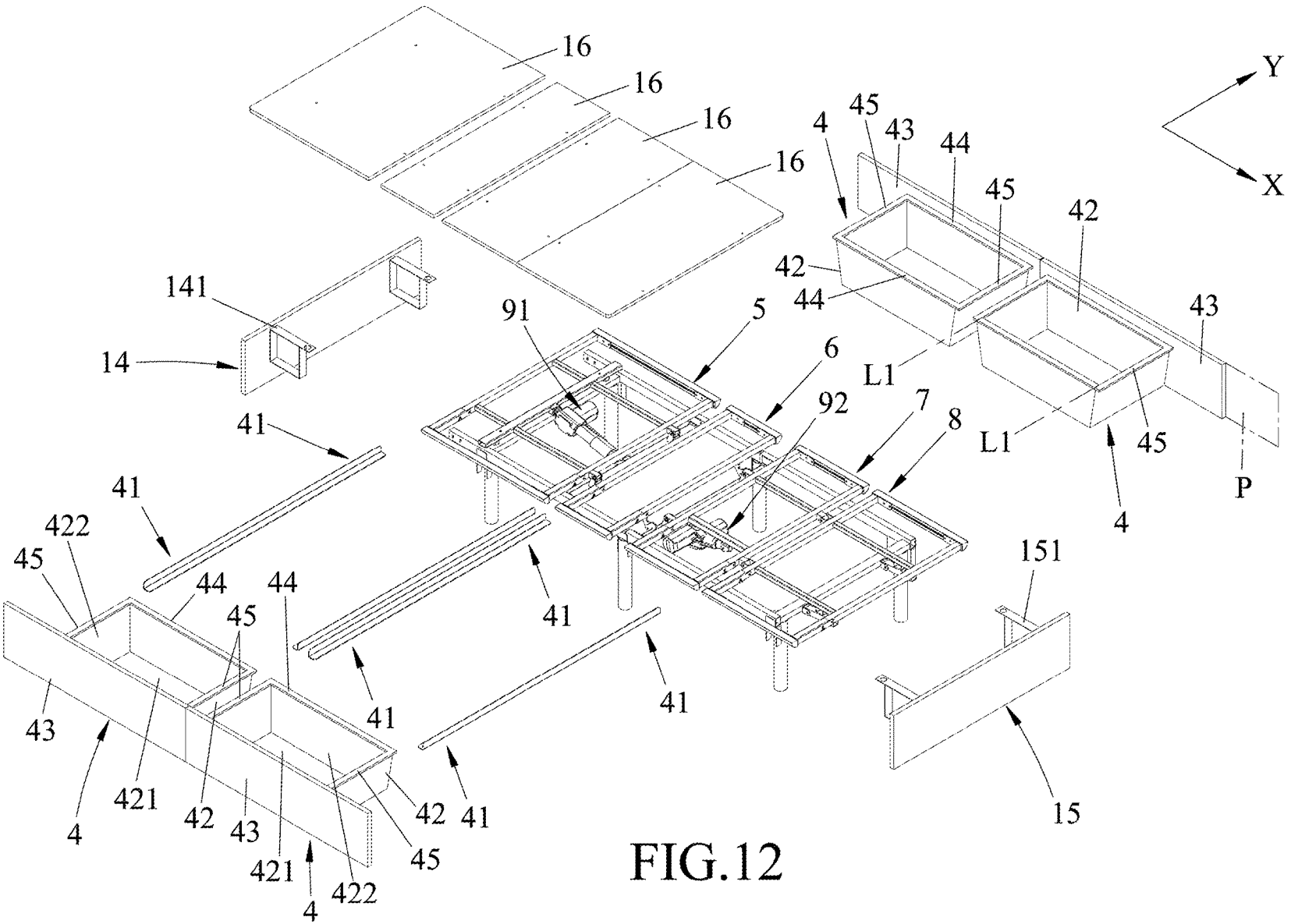
FIG. 12 is an exploded perspective view of a modular bed assembly according to a third embodiment of the disclosure.
Figure 14:
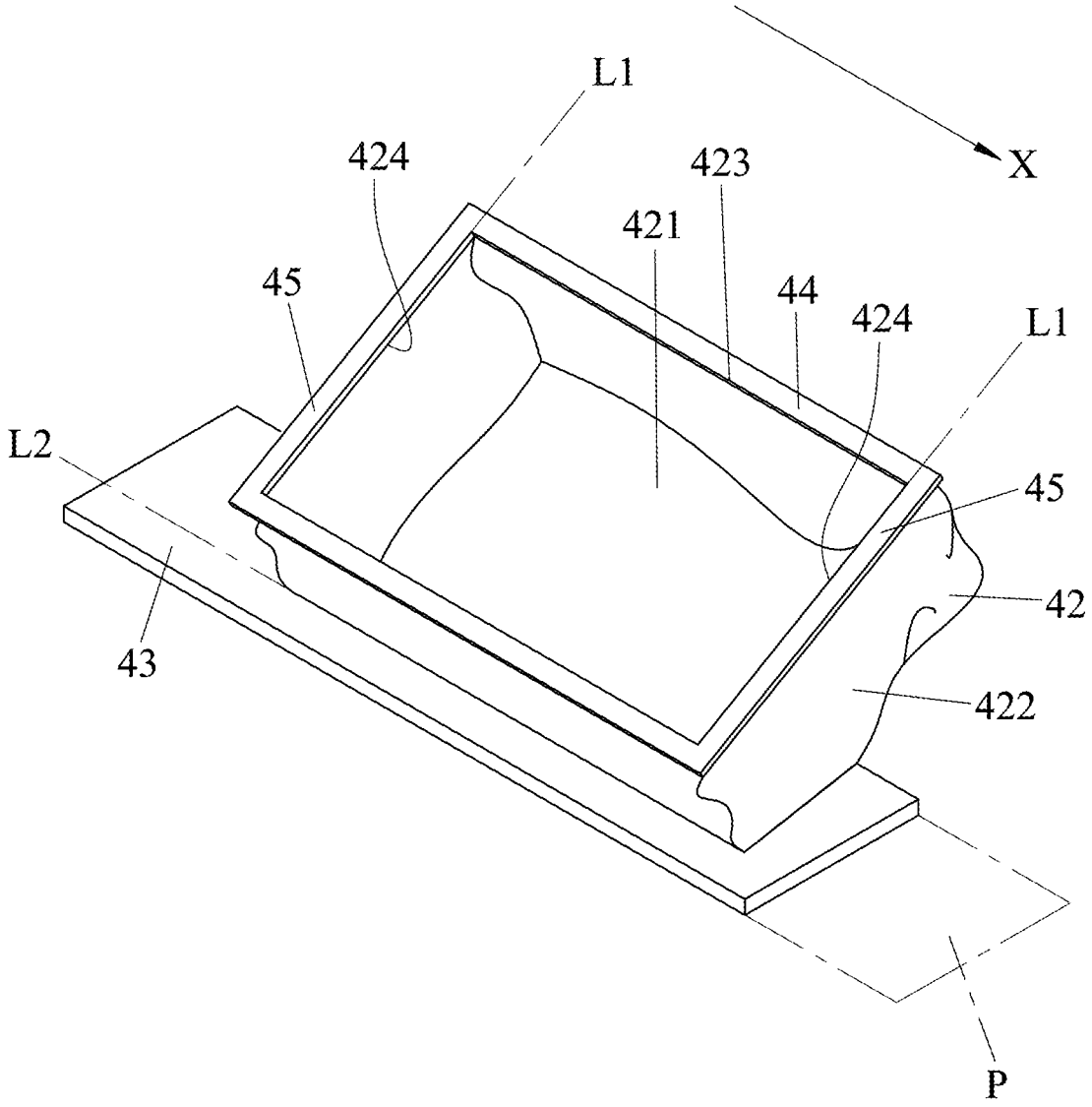
FIG. 14 is a perspective view of a drawer unit for the modular bed assembly of the third embodiment in which guiding rails are omitted.
Figure 15:
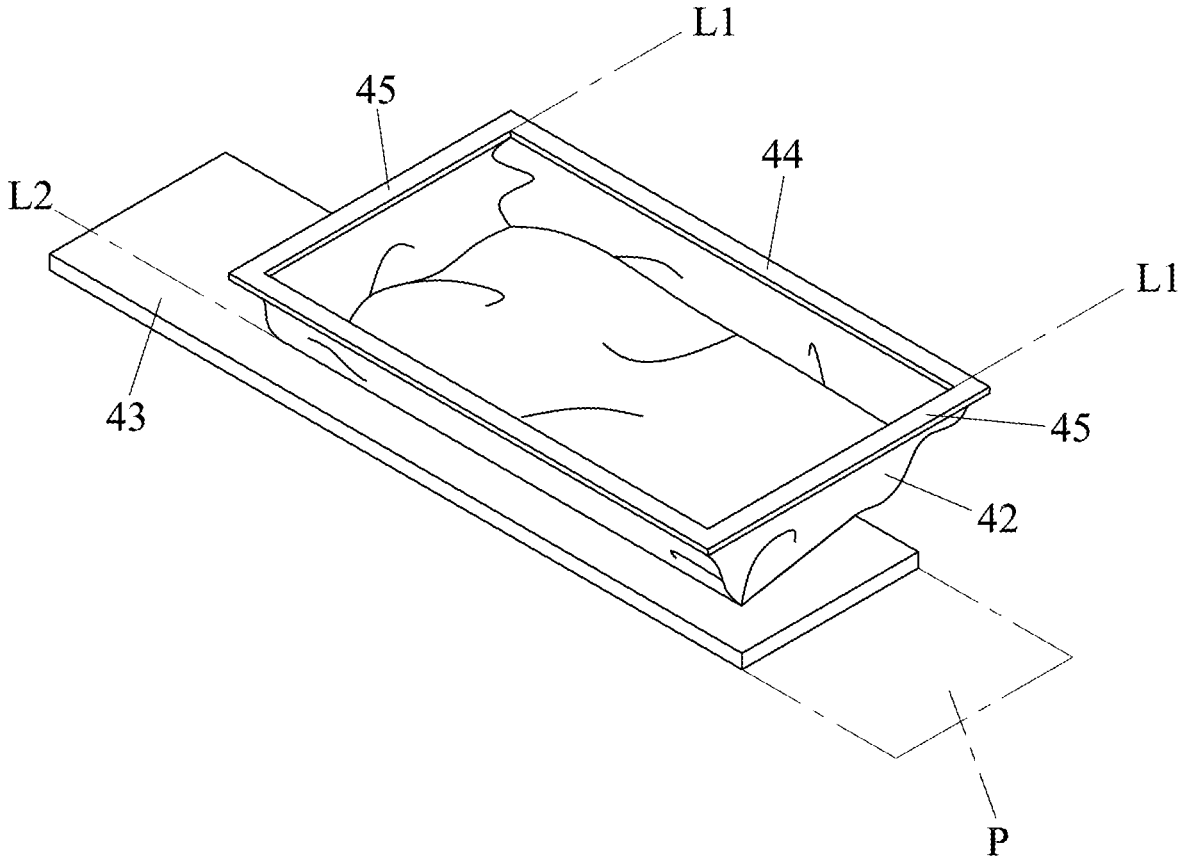
FIG. 15 is similar to FIG. 14 but illustrating a flexible receptacle of the drawer unit in a collapsed state.

The flexible receptacle 42 is transformable between a collapsed state and a deployed state. In the collapsed state, as shown in FIG. 15, the lengthwise line (L1) is substantially parallel to the plane (P). In the deployed state, as shown in FIG. 12, the lengthwise line (L1) is substantially normal to the plane (P). FIG. 14 shows the flexible receptacle 42 in a state between the collapsed state and the deployed state.

Figure 13:
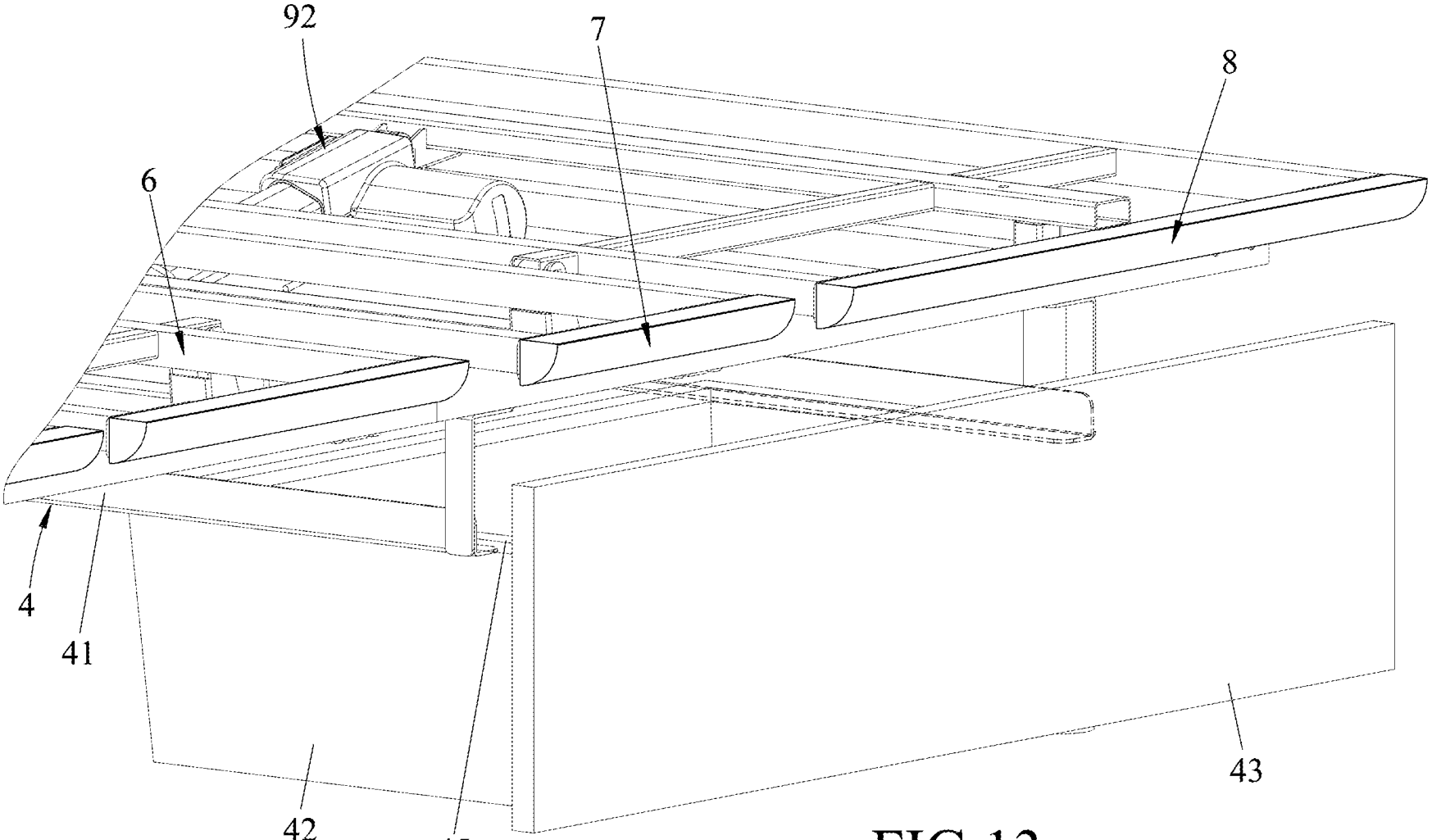
FIG. 13 is a fragmentary enlarged view of the modular bed assembly of the third embodiment.

Furthermore, in an embodiment shown in FIGS. 12 and 13, each of the guiding rails 41 has an L-shaped cross-section.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A modular bed assembly comprising:

a front base frame;

a rear base frame which is coupled to and aligned with said front base frame in a longitudinal direction to permit said front and rear base frames to be arranged in a head-to-tail arrangement;

a plurality of legs configured to elevate and place said front and rear base frames in a stationary state; and a drawer unit including:

a pair of guiding rails which are mounted beneath one of said front and rear base frames, and which are spaced apart from each other in the longitudinal direction;

a lateral faceplate defining a plane;

a flexible receptacle including a bottom wall, and a peripheral wall extending upwardly from a periphery of said bottom wall to terminate at an upper marginal edge which has two lateral edge segments each defining a lengthwise line, said peripheral wall being attached to said lateral faceplate along a longitudinal line such that said flexible receptacle is transformable between a collapsed state, where the lengthwise line is substantially parallel to the plane, and a deployed state, where the lengthwise line is substantially normal to the plane; and a pair of guided members each of which extends lengthwise to permit a respective one of said lateral edge segments to be attached thereto along the lengthwise line, and each of which is configured to be slidably retained and guided by a respective one of said pair of guiding rails so as to permit said flexible receptacle to be kept in the deployed states.

2. The modular bed assembly according to claim 1, wherein said lateral faceplate is made of a rigid material.

3. The modular bed assembly accordingly to claim 2, wherein said lateral faceplate has a longitudinal dimension substantially not greater than that of a corresponding one of said front and rear base frames.

4. The modular bed assembly according to claim 1, wherein said drawer unit further includes a pair of drawer-side rollers disposed respectively on said pair of guided members, and a pair of rail-side rollers disposed respectively on said pair of guiding rails.

5. The modular bed assembly according to claim 1, wherein said drawer unit further includes a pair of crosspieces each interconnecting said pair of guided members, said pair of crosspieces and said pair of guided members being integrally formed so as to stiffen said upper marginal edge of said flexible receptacle.

6. The modular bed assembly according to claim 1, where said front base frame includes:

two front beams each of which extends in the longitudinal direction to terminate at a front end segment and a first connecting end segment, and each of which has an intermediate segment between said front end segment and said first connecting end segment, said front beams being spaced apart from each other in a transverse direction relative to the longitudinal direction;

a first front transverse beam extending to interconnect said front end segments of said front beams; and a second front transverse beam extending to interconnect said intermediate segment of said front beams, and said rear base frame includes:

two rear beams which are spaced apart from each other in the transverse direction, each of said rear beams extending in the longitudinal direction to terminate at a rear end segment and a second connecting end segment that is connected to said first connecting end segment of a respective one of said front beams;

a first rear transverse beam extending to interconnect said second connecting end segment of said rear beams; and a second rear transverse beam extending to interconnect said rear end segments of said rear beams.

7. The modular bed assembly according to claim 6, further comprising:

a front faceplate which is detachably mounted to said front base frame so as to hide from view a space between said first front transverse beam and the ground; and a rear faceplate which is detachable mounted to said rear base frame so as to hide from view a space between said second rear transverse beam and the ground.

8. The modular bed assembly according to claim 6, further comprising:

a first front support frame unit mounted on said front base frame, and including:

a front leading bar extending in the transverse direction;

a pair of head support links each having:

a front link pivot end mounted pivotally on said second front transverse beam about a front axis in proximity to a respective one of said intermediate segments of said front beams; and a front link coupling end which is opposite to said front link pivot end, and which is connected to said front leading bar to permit said pair of head support links to move with said front leading bar such that said front leading bar is rotatably liftable about said front axis from a head normal position, where said front leading bar is close to the ground, to a head elevated position, where said front leading bar is remote from the ground; and a first front intermediate bar extending in the transverse direction to interconnect said pair of head support links in proximity to said front link pivot ends of said pair of head support links so as to move with said pair of head support links;

a second front support unit mounted on said front base frame, and disposed rearwardly of said first front support frame unit, said second front support frame unit including:

a front trailing bar which is spaced apart from said first front intermediate bar in the longitudinal direction, and which extends in the transverse direction; and a second front intermediate bar that extends in the transverse direction, and which is disposed between said first front intermediate bar and said front trailing bar, said second from front intermediate bar, together with said front trailing bar, being secured on said front beams;

a first rear support frame unit mounted on said rear base frame, and including:

a rear leading bar extending in the transverse direction;

a pair of front leg support links each having a first forward pivot end segment, a first rearward pivot end segment, and a first link body disposed between said first forward pivot end segment and said first rearward pivot end segment, said first forward pivot end segment being mounted pivotally on said first rear transverse beam about a rear axis in proximity to a respective one of said second connecting end segment of said rear beams, and being connected to said first link body through said rear leading bar so as to permit said rear leading bar to move with said pair of front leg support links; and a first rear intermediate bar which extends in the transverse direction to interconnect said first link body and said first rearward pivot end segment of each of said pair of front leg support links so as to permit said first rear intermediate bar to be rotatably liftable about said rear axis from a leg normal position, where said first rear intermediate bar is close to the ground, to a leg elevated position, where said first rear intermediate bar is remote from the ground; and a second rear support frame unit mounted on said rear base frame, and disposed rearwardly of said first rear support frame unit, said second rear support frame unit including:

a rear trailing bar which is spaced apart from said first rear intermediate bar in the longitudinal direction, and which extends in the transverse direction;

a pair of rear leg support links each having:

a second forward pivot end which is hingedly mounted to said first rearward pivot end segment of a respective one of said pair of front leg support links; and a second rearward connected end which is opposite to said second forward pivot end, and which is mounted on said rear trailing bar, and a second rear intermediate bar extending in the transverse direction through said pair of rear leg support links in proximity to said second forward pivot ends of said pair of rear leg support links so as to permit said second rear intermediate bar to be lifted when said first rear intermediate bar is lifted to said leg elevated position from said leg normal position.

9. The modular bed assembly according to claim 8, further comprising:

a front jack member coupled between said front base frame and said first front support frame unit so as to permit said front leading bar to be driven by said front jack member to move between the head normal position and the head elevated position; and a rear jack member coupled between said rear base frame and said first rear support frame unit so as to permit said first rear intermediate bar to be driven by said rear jack member to move between the leg normal position and the leg elevated position.

10. The modular bed assembly according to claim 8, further comprising four support panels which are detachably mounted to said first and second front support frame units and first and second rear support frame units, respectively.

11. The modular bed assembly according to claim 8, wherein each of said front leading bar, said first front intermediate bar, said second front intermediate bar, said front trailing bar, said rear leading bar, said first rear intermediate bar, said second rear intermediate bar, and said rear trailing bar has a first end segment and a second end segment opposite to said first end segment in the transverse direction, each of said first and second front support frame units and first and second rear support frame units further including:

a first retaining member interconnecting said first end segment of two corresponding ones of said front leading bar, said first front intermediate bar, said second front intermediate bar, said front trailing bar, said rear leading bar, said first rear intermediate bar, said second rear intermediate bar, and said rear trailing bar; and a second retaining member interconnecting said second end segment of two corresponding ones of said front leading bar, said first front intermediate bar, said second front intermediate bar, said front trailing bar, said rear leading bar, said first rear intermediate bar, said second rear intermediate bar, and said rear trailing bar, said modular bed assembly further comprising:

four support webs each of which is configured to be stretchable on a respective one of said first and second front support frame units and said first and second rear support frame units, and each of which includes a web body; and two lateral portions which are at opposite sides of said web body, and that are respectively coupled to said first and second retaining members of the respective one of said first and second front support frame units and said first and second rear support frame units so as to permit said web body to be fully stretched between said respective first and second retaining members.

* * * * *